US012691983B2

(12) United States Patent
Curet

(10) Patent No.: US 12,691,983 B2
(45) Date of Patent: Jul. 28, 2026

(54) HYBRID PROPELLER/UNDULATING FIN PROPULSION FOR AQUATIC VEHICLES

(71) Applicant: FLORIDA ATLANTIC UNIVERSITY BOARD OF TRUSTEES, Boca Raton, FL (US)

(72) Inventor: Oscar Curet, Boca Raton, FL (US)

(73) Assignee: FLORIDA ATLANTIC UNIVERSITY BOARD OF TRUSTEES, Boca Raton, FL (US)

( * ) Notice: Subject to any disclaimer, the term of this patent is extended or adjusted under 35 U.S.C. 154(b) by 290 days.

(21) Appl. No.: 18/278,125

(22) PCT Filed: Mar. 23, 2022

(86) PCT No.: PCT/US2022/021541
§ 371 (c)(1),
(2) Date: Aug. 21, 2023

(87) PCT Pub. No.: WO2022/250770
PCT Pub. Date: Dec. 1, 2022

(65) Prior Publication Data

US 2024/0132188 A1 Apr. 25, 2024
US 2024/0227997 A9 Jul. 11, 2024

Related U.S. Application Data

(60) Provisional application No. 63/193,915, filed on May 27, 2021.

(51) Int. Cl.
*B63H 1/37* (2006.01)
*B63G 8/00* (2006.01)

(52) U.S. Cl.
CPC ..... *B63H 1/37* (2013.01); *B63G 2008/004* (2013.01)

(58) Field of Classification Search
CPC ..... B63H 1/37; B63G 2008/004
See application file for complete search history.

(56) References Cited

U.S. PATENT DOCUMENTS 8,025,021 B2 * 9/2011 Gosling ..... B63B 1/04 114/330
8,825,241 B2 * 9/2014 Hine ..... B63B 35/00 701/2

(Continued)

FOREIGN PATENT DOCUMENTS

CN 103213665 B 8/2015
CN 210212733 U 3/2020
CN 111422334 A 7/2020

OTHER PUBLICATIONS

Galoustian Gisele. Bio-Inspired Robotics Lands Professor $500,000 NSF Award. Florida Atlantic University. Apr. 26, 2018. [retrieved on May 31, 2022]. Retrieved from the Internet. <URL:https://www.fau.edu/newsdesk/articles/nsf-career-award.php>.

(Continued)

*Primary Examiner* — Brian Christopher Delrue
(74) *Attorney, Agent, or Firm* — Meunier Carlin & Curfman LLC

(57) ABSTRACT

An apparatus and method for an unmanned underwater vehicle that utilizes at least one flexible robotic fin to provide a highly maneuverable vessel with station-keeping performance in tight spaces, close to ocean structures or missions where a low-speed or station-keeping vehicle is required. A propeller is also provided for providing the main propulsion during high-speed transition with assistance provided by the flexible robotic fin. The vehicle includes sonar and camera equipment as well as a plurality of other sensors for achieving navigation and communication functions while surveying the underwater marine environment. A system controller and motor controller are synchronized to provide deflection (Continued)

commands to ray elements in the flexible robotic fin to achieve particular maneuvers such as pitch, yaw, and roll in confined spaces. The commands are traveling waves that undulate the fin precisely and for station-keeping the commands are opposing wave commands that fix the vehicle at one position.

20 Claims, 10 Drawing Sheets

(56) References Cited

U.S. PATENT DOCUMENTS

| | | | | |
|---|---|---|---|---|
| 10,190,570 | B1 * | 1/2019 | Filardo | B63H 1/37 |
| 10,519,926 | B2 * | 12/2019 | Filardo | F03B 13/10 |
| 10,756,596 | B2 * | 8/2020 | Ulrich-Verderber | F03B 13/10 |
| 10,823,136 | B2 * | 11/2020 | Filardo | F04B 9/02 |
| 11,465,728 | B2 * | 10/2022 | Filardo | B64B 1/24 |
| 12,264,666 | B2 * | 4/2025 | Filardo | F03B 17/06 |
| 2004/0008853 | A1 * | 1/2004 | Pelrine | A61M 60/268 417/474 |
| 2004/0043677 | A1 * | 3/2004 | Yamamoto | B63H 1/36 440/15 |
| 2004/0197519 | A1 * | 10/2004 | Elzey | B32B 3/28 428/116 |
| 2025/0256828 | A1 * | 8/2025 | Sankrithi | B64B 1/58 |

OTHER PUBLICATIONS

International Search Report and Written Opinion issued in PCT/US2022/021541, mailed Dec. 1, 2022.

* cited by examiner

HYBRID PROPELLER/UNDULATING FIN PROPULSION FOR AQUATIC VEHICLES

CROSS-REFERENCE TO RELATED APPLICATIONS

This application is a National Stage of International Application No. PCT/US2022/021541, filed on Mar. 23, 2022, which claims the benefit under 35 U.S.C. § 119 (e) of U.S. Patent Application Ser. No. 63/193,915, filed on May 27, 2021, entitled HYBRID PROPELLER/UNDULATING FIN PROPULSION FOR AQUATIC VEHICLES, all of whose entire disclosures are incorporated by reference herein.

STATEMENT REGARDING FEDERALLY SPONSORED RESEARCH OR DEVELOPMENT

This invention was made with government support under grant number 1751548 awarded by the National Science Foundation. The Government has certain rights in the invention.

BACKGROUND OF THE INVENTION

The present invention relates in general to underwater aquatic vehicles with flexible robotic fins for enhanced maneuverability.

Despite the benefits of aquatic robotic systems for undersea exploration, their limited maneuverability and station-keeping performance prevent their navigation in tight spaces, close to ocean structures or missions where a low-speed or station-keeping is needed. To address this issue, this invention comprises of a hybrid propulsion system that effectively integrates a flexible fin with a propeller for aquatic vehicles. The new propulsion will allow aquatic vehicles to perform advance force control in multiple directions while retaining its high-speed performance. This new functionality will permit smarter surveys and inspections reports where more detailed data is provided in regions of interest and sparser data elsewhere.

All references cited herein are incorporated herein by reference in their entireties.

BRIEF SUMMARY OF THE INVENTION

An unmanned underwater vehicle for maneuvering in tight spaces, close to ocean structures or missions where a low-speed or station keeping function is necessary is disclosed. The vehicle comprises: a hydrodynamically-shaped hull having at least one robotic fin positioned on an external surface of the hull, wherein the at least one robotic fin is flexible such that portions of the fin can undulate to cause the hull to pitch, yaw, or roll in a confined underwater space; a sonar device for detecting underwater objects proximate the vehicle; and a controller, coupled to the sonar device, that commands the at least one robotic fin using at least one traveling sinusoidal wave to undulate the at least one robotic fin and maneuver in the confined underwater space.

A method for maneuvering an unmanned underwater vehicle in tight spaces, close to ocean structures or missions where a low-speed or station keeping function is necessary is disclosed. The method comprises: providing a hydrodynamically-shaped hull with at least one robotic fin positioned on an external surface of the hull, wherein the at least one robotic fin is flexible such that portions of the fin can undulate to cause the hull to pitch, yaw, or roll in a confined underwater space; providing the hull with a sonar device for detecting underwater objects proximate the vehicle; coupling the sonar device to a controller within the hull for providing the controller with data regarding objects in the vicinity of the vehicle; and commanding the at least one robotic fin using at least one traveling sinusoidal wave, by the controller, to undulate the at least one robotic fin and maneuver the vehicle in the confined underwater space.

BRIEF DESCRIPTION OF SEVERAL VIEWS OF THE DRAWINGS

Many aspects of the present disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION OF THE PREFERRED EMBODIMENTS

Figure 1A:
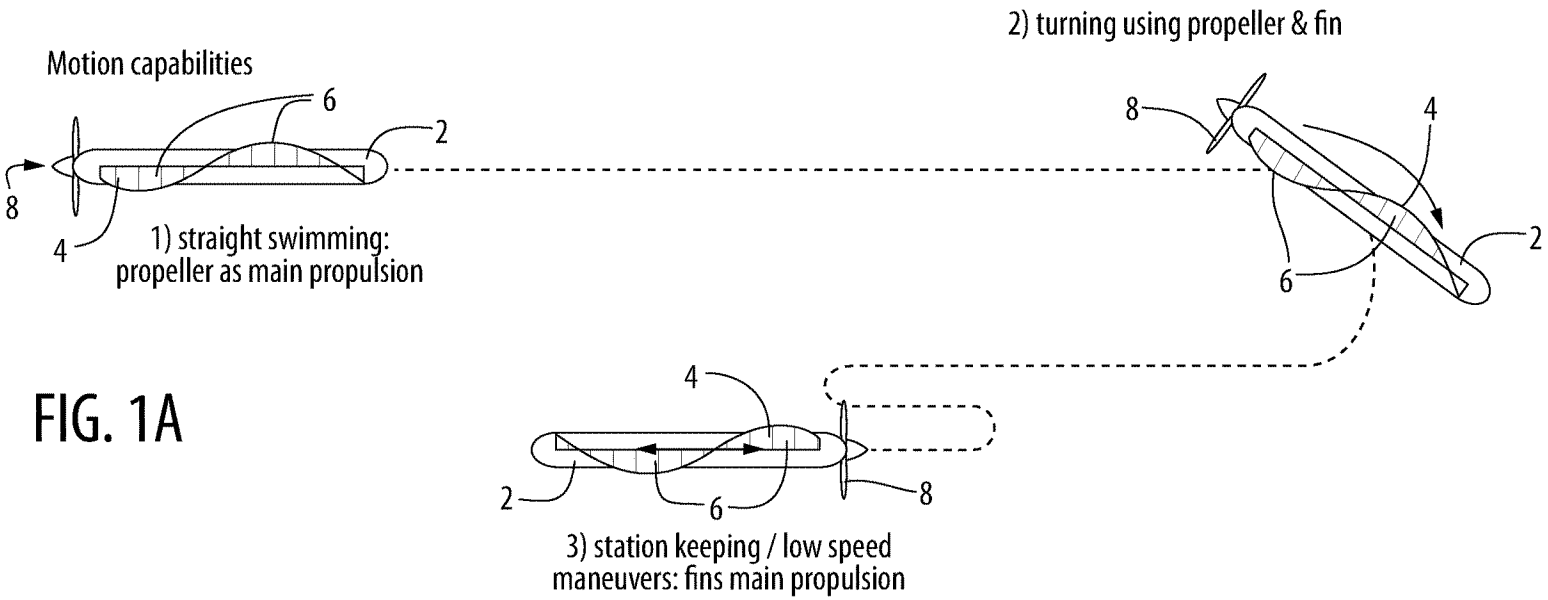
FIG. 1A is a diagram illustrating the concept design for the underwater vehicle's exemplary motion capabilities.

As will be described below, the present invention is capable of increasing maneuverability in tight spaces, close to ocean structures, or where a low speed is necessary. The integration of a flexible fin into a hybrid propulsion system using a propeller in aquatic vehicles permits the vehicles to have advanced force control in multiple directions while still retaining a high speed.

The flexible fins will provide two new main functionalities. First, at high-speed operation when the propeller is providing thrust, a longitudinal morphing fin deployed as a control surface to allow stability and provide forces to adjust heading and turning. Second, the fin will be engaged to undulate to provide primary thrust and directional maneuver control for low-speed operation or station keeping. This new hybrid propulsion architecture will enable unmanned aquatic vehicles novel functionality where they can survey large spaces, as they currently do, but also navigate at low speed or perform station-keeping when a more detailed inspection in a specific area is required.

Currently, unmanned aquatic vehicles use a variety of techniques for motion control, including single thrusters with diving planes or hydrofoils, robotic wrists, or a moving mass, but in these configurations, the vehicles must move horizontally in order to change direction of movement. Moreover, although propellers are efficient at high-speed velocities, their efficiency and ability to generate thrust diminish at low speed. The hybrid propulsion system may utilize flexible and morphing fins to enhance the mobility and station-keeping abilities of current high-speed aquatic vehicles. Thus, the main advantage of the new propulsion system is to provide for aquatic vehicles the ability to perform advanced force control in multiple directions while retaining high-speed performance. Thus, this hybrid propulsion will allow a new class of vehicles that are concurrently fast, efficient, and maneuverable.

The innovation of this product is related marine propulsion technology and control strategy of an autonomous aquatic vehicle for the synergistic operation of a morphing/undulating fin and a conventional propeller. At high speed the propeller will provide the main propulsion for the system and the fin will serve as a control surface to adjust the orientation of the vessel and the control of directional forces for turnings. For low-speed operations, the fin will undulate to provide thrust for forward motion and directional maneuvers. The rich locomotive capability of the undulating fin will allow the vessel to maneuver in many directions, including forward, backward, rapid reverse, upward, forward-lateral, and station keeping.

This technology has applications in marine industries such as offshore energy, defense, and marine research require sensing capabilities in aquatic environments in a variety of water conditions and space constrictions. Typical applications include: 1) inspection, maintenance, and repair (examples: oil and gas pipelines, underwater cables, hull inspections, and harbor and coastal structures); 2) military and defense (examples: marine reconnaissance vehicles, harbor perimeter security, and fleet protection); 3) hydrographic survey (for environmental, marine construction, and sub-marine navigation projects); 4) underwater exploration, search, and salvage operations, and 5) scientific research.

This hybrid propulsion system is expected to drastically increase the mission scope of a single aquatic robotic system. The robotic system could allow for a streamlined, hydrodynamical shape that utilizes a propeller for high-speed operation and a fin to correct heading directions or perform turning maneuvers. At low speed when high maneuverability is needed, the undulating fin will provide necessary forces and torques. Having a flexible undulating fin could allow the vehicle to get much closer to valuable assets without the risk of damage, provide precise station keeping, and reduce the noise signature of the propulsion system given that the fin undulates at much lower frequency that a conventional propeller.

Referring now to the figures, wherein like reference numerals represent like parts throughout the several views, exemplary embodiments of the present disclosure will be described in detail. Throughout this description, various components may be identified having specific values, these values are provided as exemplary embodiments and should not be limiting of various concepts of the present invention as many comparable sizes and/or values may be implemented.

FIG. 1A is a diagram illustrating the concept design for the underwater vehicle's exemplary motion capabilities. In this exemplary embodiment, the underwater vehicle 2 comprises a hydrodynamically-shaped hull 5 (FIGS. 3-4) to which a single robotic fin 4 is coupled and wherein the fin 4 can be undulated 6 to for maneuvering the vehicle 2; a propeller 8 is located at the rear of the vehicle 2 for providing the main propulsion. When the underwater vehicle 2 is propelled in a straight direction, the propeller 8 serves as the main source of propulsion. Upon a need of turning the underwater vehicle 2, the underwater vehicle 2 uses both the propeller 8 and the robotic fin 4 to both propel and steer the vehicle. When the underwater vehicle 2 is operating at low speeds or is in station keeping mode wherein the underwater vehicle's 2 operation is maintained to match other vehicles in a marine fleet, the robotic fin 4 serves as the main source of propulsion.

Figure 1B:
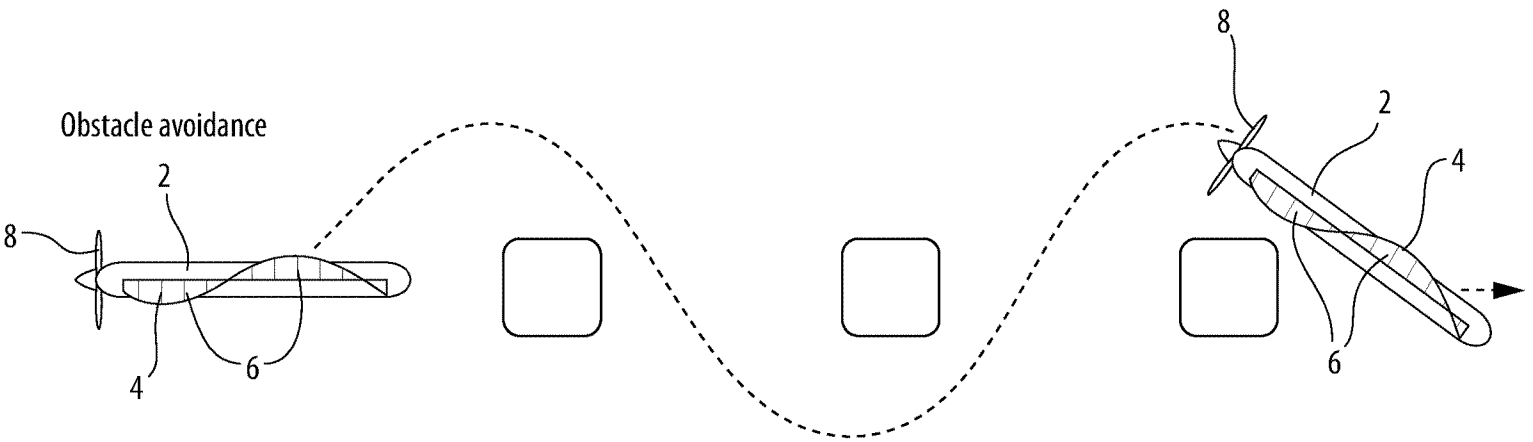
FIG. 1B is a diagram illustrating the concept design for the underwater vehicle's exemplary obstacle avoidance capabilities.

FIG. 1B is a diagram illustrating the concept design for the underwater vehicle's 2 exemplary obstacle avoidance capabilities. In this exemplary embodiment, both the propeller 8 and the robotic fin 4 of the underwater vehicle 2 are simultaneously activated to propel the underwater vehicle 2 while still permitting the underwater vehicle 2 to change direction. The undulations of the robotic fin 4 permit the vehicle 2 to operate the propeller 8 at a lower power than an underwater vehicle 2 containing only a propeller 8 and permit the underwater vehicle 2 to navigate closer to ocean obstacles or within tight spaces without collation and without the need for a human operator.

Figure 2A:
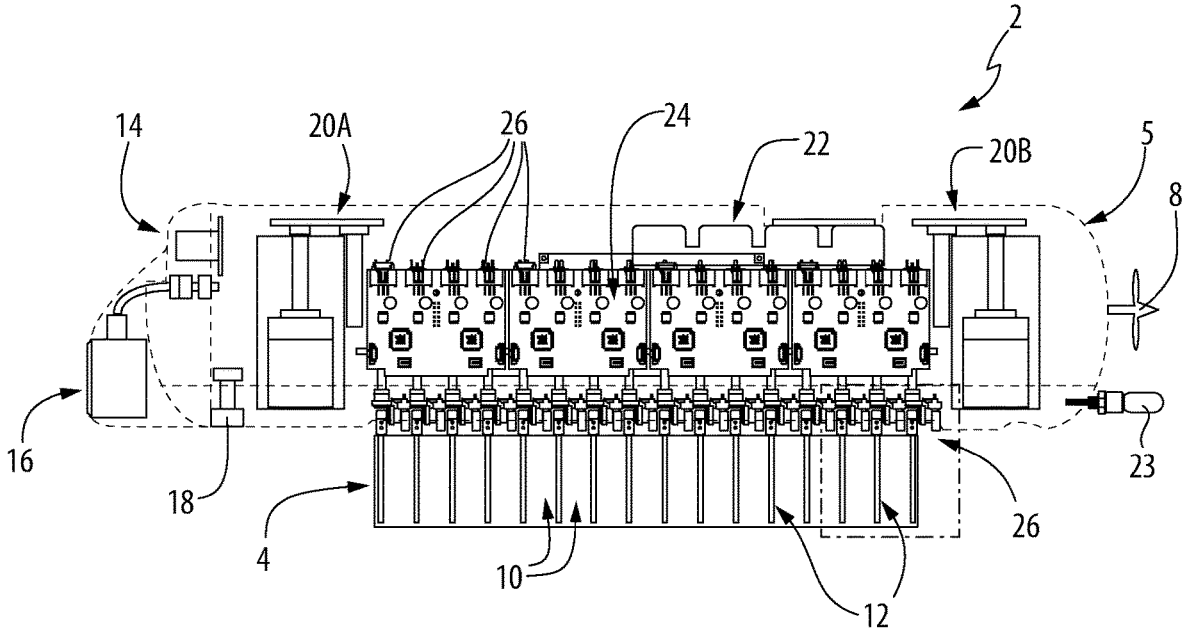
FIG. 2A is a cross-sectional view of an exemplary embodiment of an unmanned underwater vehicle.

FIG. 2A is a cross-sectional view of the hull 5 of an exemplary embodiment of the unmanned underwater vehicle 2 of the present invention. The unmanned underwater vehicle 2 includes a flexible robotic fin 4, which includes a stretchable membrane 10 supported by a plurality of rays 12. Each ray 12 is separately controlled by an actuator 26, allowing each ray 12 to move independently form the other and permit the robotic fin 4 to undulate when it is necessary to turn the vehicle 2 or maintain the vehicle's 2 direction when all of the rays 12 are pointed in the same direction. Although only a single flexible robotic fin 4 is shown located on the ventral (viz., bottom) side 7 (FIG. 4) of the vehicle 2, it should be understood that the underwater vehicle 2 may also include a plurality of fins 4 coupled at other locations around the circumference of the exterior of the vehicle 2. Each ray 12 of the robotic fin 4 is controlled by an individual actuator 26, wherein each actuator 26 may include one of a motor driver, hydraulic actuator, pneumatic actuator, electric actuator, thermal actuator, magnetic actuator, or another actuator capable of linear or rotary functions. As shown by way of example only, each actuator 26 may also comprise a motor 26A (e.g., a DC motor), motor coupling 26B (FIG. 2B) for activating a bevel gear assembly 26C (FIG. 2B) for deflecting a corresponding ray 12 to undulate the fin 4 and change direction of the vehicle 2. As each ray 12 is controlled by a separate actuator 26, the fin 4 is capable of moving in an undulating, sinusoidal pattern based upon a traveling wave input. The underwater vehicle 2 may also include a propeller 8 mounted at the rear of the vehicle 2, wherein the propeller 8 provides the necessary propulsion for the underwater vehicle 2 in synergy with the robotic fin 4 when the underwater vehicle 2 is moving at high speeds or is changing direction. Internal of the hull 5 of the underwater vehicle 2 is at least one camera 14 mounted near the head of the underwater vehicle 2, wherein the camera 14 is capable of recording video and/or taking photographs of the environment surrounding the underwater vehicle 2. The underwater vehicle 2 may also include sonar equipment 16 mounted on the exterior of the underwater vehicle 2 to detect the presence of obstacles, objects, or other aquatic vehicles. To assist in navigation, the underwater vehicle 2 may also include a pressure sensor 18 to determine the depth of the underwater vehicle 2 in an aquatic environment. To control the depth of the underwater vehicle 2, the underwater vehicle 2 may also include at least one variable ballast (by way of example only, two variable ballasts 20A and 20B are depicted) permitting the underwater vehicle 2 to adjust its buoyancy and descend or surface within the water. The underwater vehicle 2 may also include at least one battery 22 to power the underwater vehicle 2 and may include a microcontroller 24 to process input sent from a remote operator of the underwater vehicle 2. In certain embodiments, the length of the vehicle 2 may range from 22-24 inches. In other embodiments, the length of the vehicle 2 may be over two feet in length. A recharge boom 23 is also depicted in FIG. 2A for recharging the batteries 22; this boom 23 may also be used to conveying serial data out of or into the vehicle 2.

The fin 4 may comprise a single flexible material into which are embedded a plurality of the rays 12; alternatively, the fin 4 may comprise a plurality flexible material segments that are joined together with the rays 12.

Figure 2B:
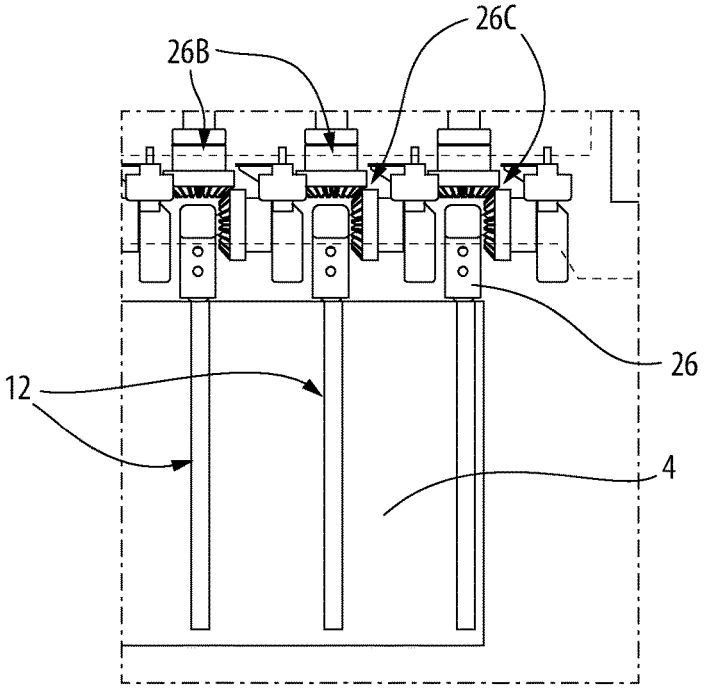
FIG. 2B is a partial view of an exemplary actuator for undulating the robotic fin.

FIG. 2B is a partial view of an exemplary actuator for undulating the robotic fin. The fin 4 includes a plurality of rays 12, wherein each ray 12 is controlled by an individual actuator 26. By way of example, each actuator may comprise a motor 26A (e.g., a DC motor), motor coupling 26B for activating a bevel gear assembly 26C for deflecting a corresponding ray 12 to undulate the fin 4 and change direction of the vehicle 2. As each ray 12 is controlled by a separate actuator 26, the fin 4 is capable of moving in an undulating, sinusoidal pattern based upon a traveling wave input.

Figure 3:
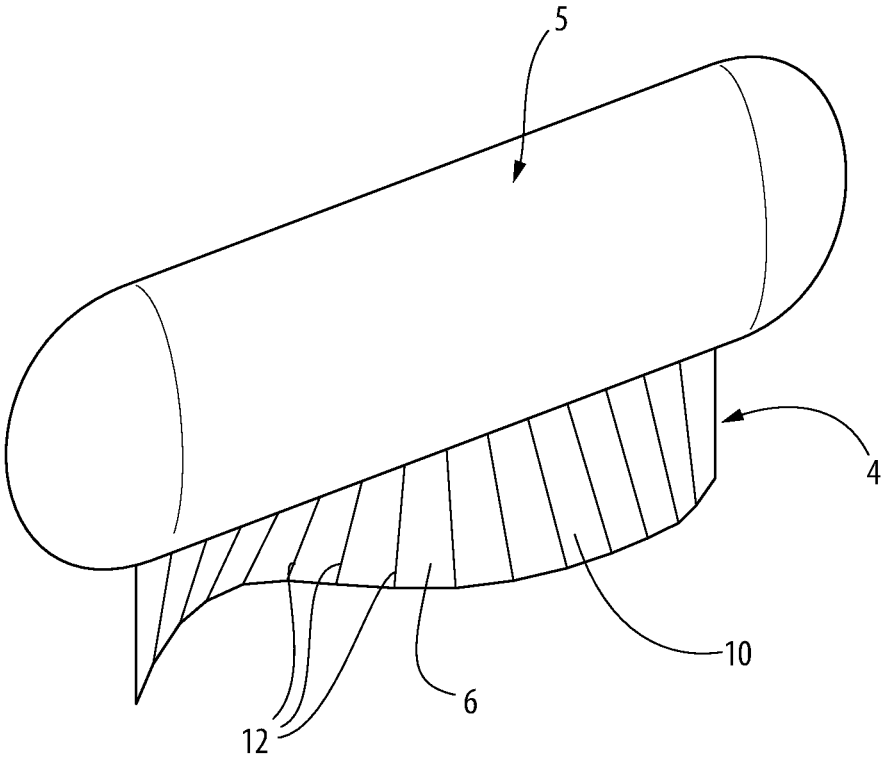
FIG. 3 is a perspective view of the exterior of an exemplary embodiment of the underwater vehicle.

FIG. 3 is a perspective view of the exterior of an exemplary embodiment of the underwater vehicle 2. In certain embodiments, the robotic fin 4 is coupled to the underside of the underwater vehicle 2 and is the only means of propulsion for the vehicle 2, wherein the fin 4 includes a stretchable membrane 10 and a plurality of rays 12 supporting the stretchable membrane 10 permitting the fin 4 to have undulations 6 during operation and change the direction of the underwater vehicle 2.

Figure 4:
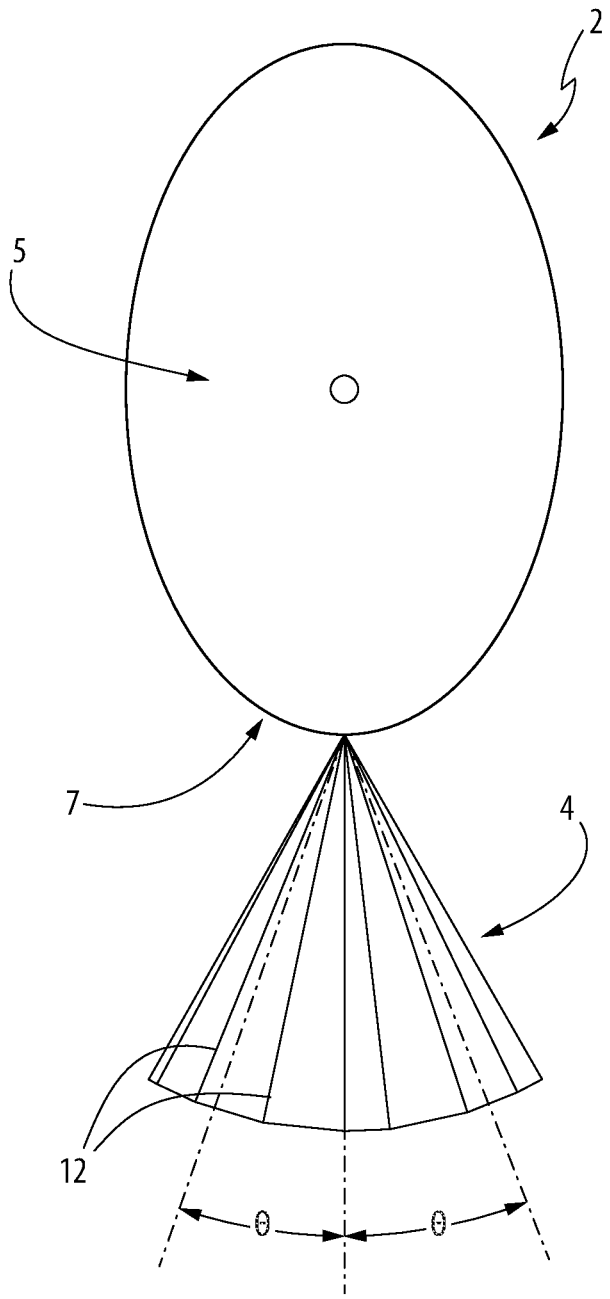
FIG. 4 is a functional front view of the exterior of an exemplary embodiment of the underwater vehicle and depicts the fin deflection angle, θ.

FIG. 4 is a functional front view of the exterior of an exemplary embodiment of the underwater vehicle 2. In certain embodiments, the underwater vehicle 2 may include a robotic fin 4 mounted on the rear of the underwater vehicle 2 to permit directional control of the underwater vehicle 2. FIG. 4 also provides a definition of the angle of deflection, θ, that each ray 12 can be driven when implementing a particular fin configuration. The amount of the angle of deflection θ is proportional to the amount of turn or torque of the vehicle 2.

Figure 5:
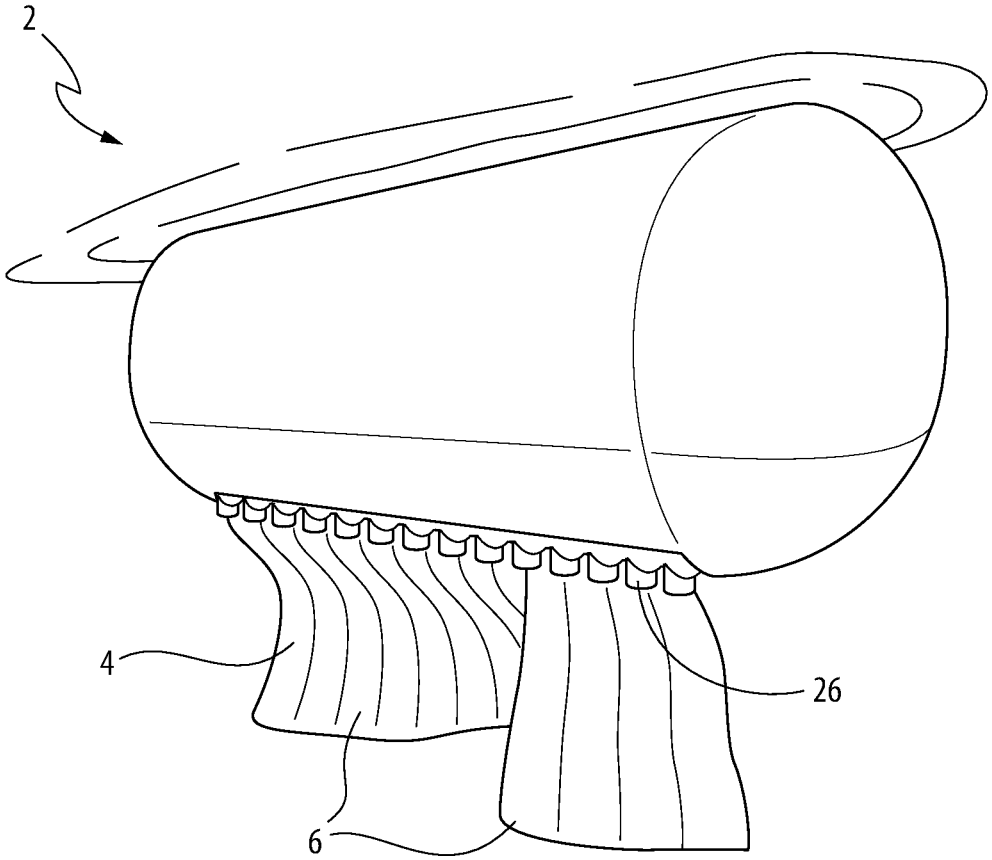
FIG. 5 is a perspective view of an exemplary embodiment of the underwater vehicle.

FIG. 5 is a perspective view of an exemplary embodiment of the underwater vehicle 2. In this exemplary embodiment, the robotic fin 4 is mounted to the underside of the underwater vehicle 2. The robotic fin 4 comprises a stretchable membrane 10 supported by a plurality of rays 12, wherein each ray 12 (FIG. 3) is controlled by a separate actuator 26. In certain exemplary embodiments, the stretchable membrane may include lycra or silicon rubber. In certain exemplary embodiments, the actuators 26 controlling each ray 12 of the fin 4 may be controlled in unison by a microprocessor 24 (FIG. 3) permitting the fin 4 to move as a single unit, or the microprocessor 24 (FIG. 3) may control each actuator 26 separately, permitting each actuator 26 to move independently and enable the fin 4 to have undulations 6 and change the direction of the underwater vehicle 2.

Figure 6:
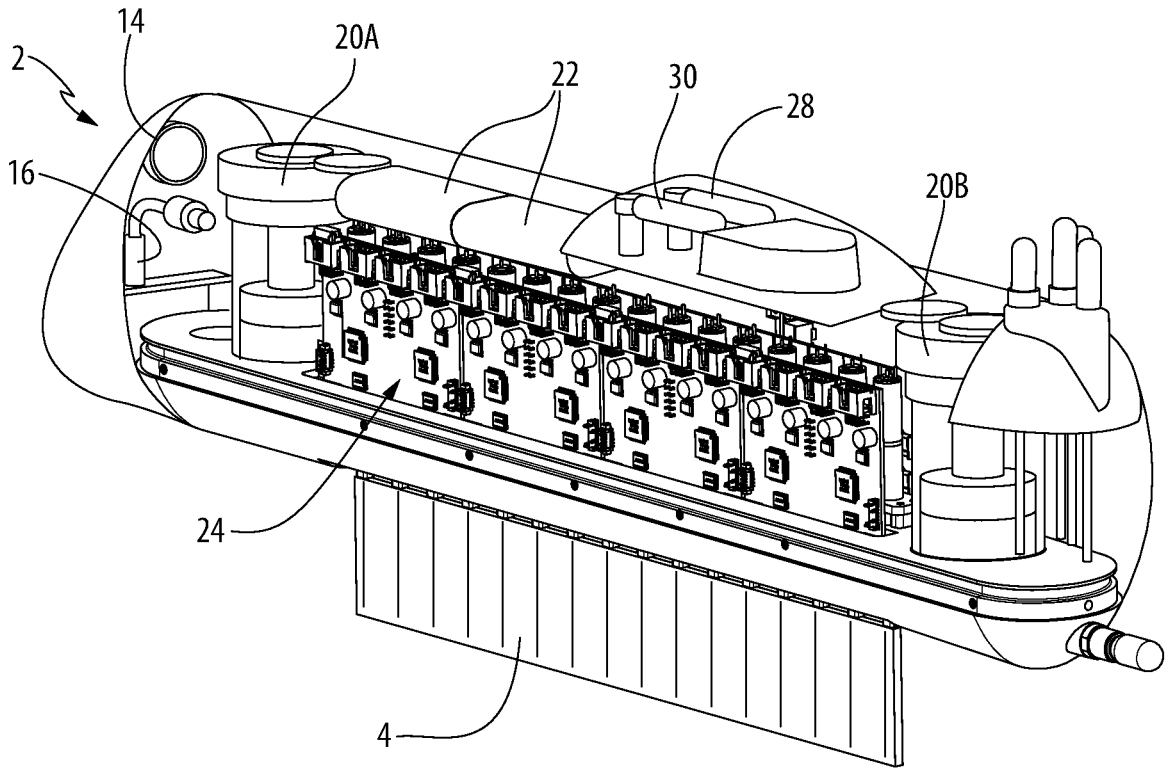
FIG. 6 is a perspective, cross-sectional view of an exemplary embodiment of the underwater vehicle.

FIG. 6 is a perspective, cross-sectional view of an exemplary embodiment of the underwater vehicle, which depicts the sonar equipment 16, the camera 14, the pair of variable ballasts 20A/20B, a plurality of batteries 22, a microcontroller 24 (FIGS. 8A and 8B), and the robotic fin 4, wherein the fin 4 includes the stretchable membrane 10 supported by a plurality of rays 12. A communications/navigation equipment suite is shown on the top of the vehicle 2. This suite includes radio/antenna 28 (e.g., Zigbee radio) for permitting communication between an external operator and the vehicle 2, as well as underwater acoustic communication. Moreover, the underwater vehicle 2 also includes a global positioning system (GPS) with antenna 30 (e.g., GPS with real-time kinetic positioning), permitting an external operator to determine the location of the vehicle 2, along with an inertial measurement unit (IMU). The underwater vehicle 2 also includes plurality of sensors, which may include but are not limited to acoustic sensors, seismometers, sonar sensors, wave sensors, electromagnetic sensors, barometric sensors, and temperature sensors. By way of example only, the underwater vehicle 2 includes acoustic sensor, sonar equipment 16, the camera 14 working synergistically with the inertial measurement unit that, when employed in tandem with the pressure sensor 18 (FIG. 2A), permits the underwater vehicle 2 to have full navigation ability in its surroundings and be completely autonomous. The microcontroller 24 may include preset commands or control parameters to deflect the fin 4 by deflecting the rays 12 (FIG. 3) to accomplish certain maneuvers, such as such change the amplitude or frequency of the fin's 4 undulations 6 (FIG. 5), or deflecting the fin 4 to one side or another for turning or changing the pitch of the underwater vehicle 2.

Figure 7:
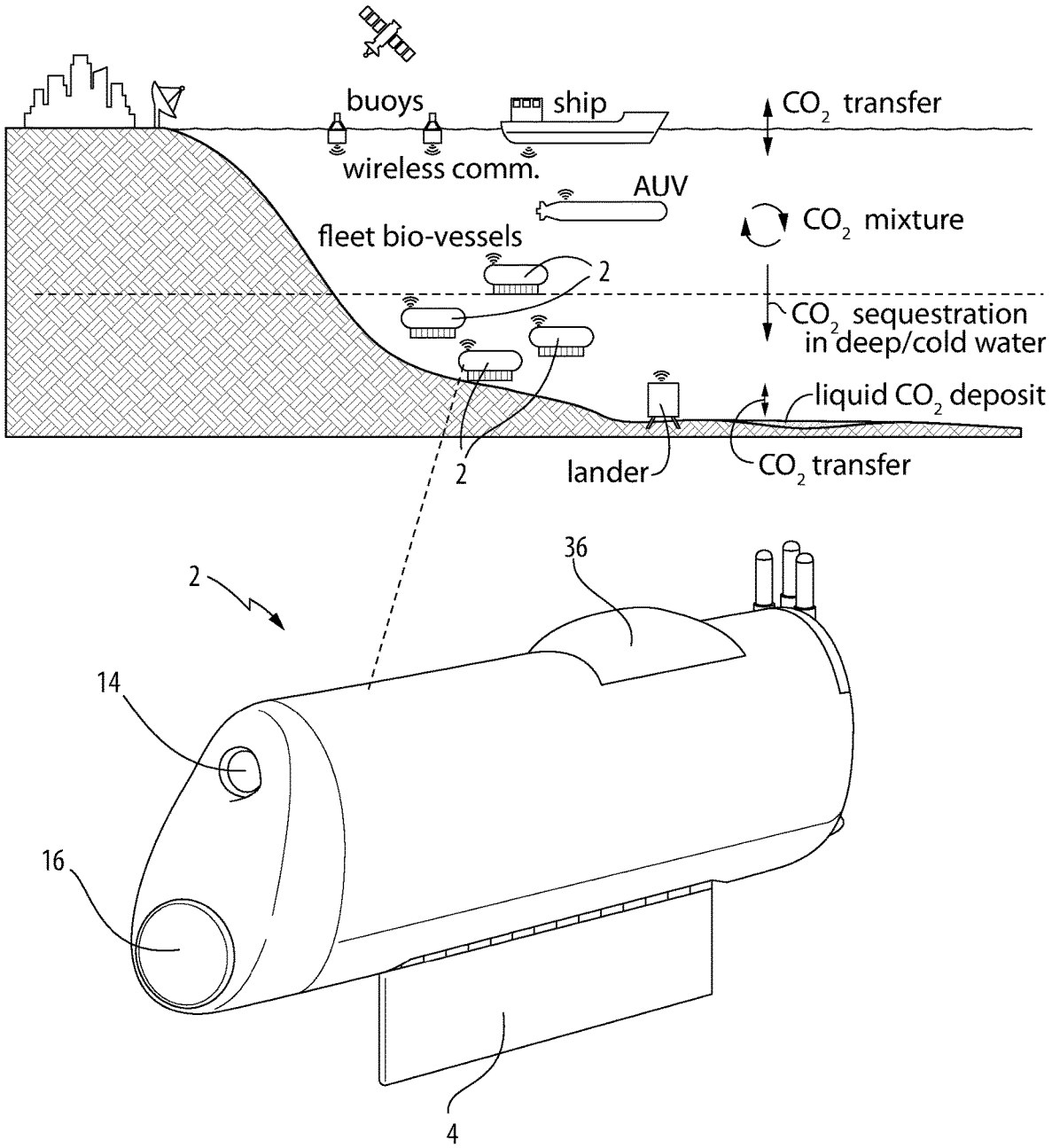
FIG. 7 is a diagram illustrating an exemplary concept design of the underwater vehicle including an exploded perspective view of the underwater vehicle.

FIG. 7 is a diagram illustrating an exemplary concept design of the underwater vehicle including an exploded perspective view of the underwater vehicle. The diagram shows a plurality of underwater vehicles 2, wherein each underwater vehicle 2 is capable of transmitting and receiving wireless communications between the underwater vehicle 2 and an external operator, other underwater vehicle 2, air-based vehicle, land-based vehicle, or other aquatic structure (e.g., buoys, surface ships, submarine or other submerged vehicles, unmanned vehicles, coastal equipment, lander units, etc. FIG. 7 additionally shows an exploded view of an exemplary embodiment of the underwater vehicle 2 including the radio equipment 28 (FIG. 6) enabling remote operation and GPS equipment 30 (FIG. 6) covered by an antenna housing 36, a robotic fin 4, a camera 14, sonar equipment 16, and the plurality of sensors used for localization of the underwater vehicle 2 and communication between the vehicle and an external source.

Figure 8A:
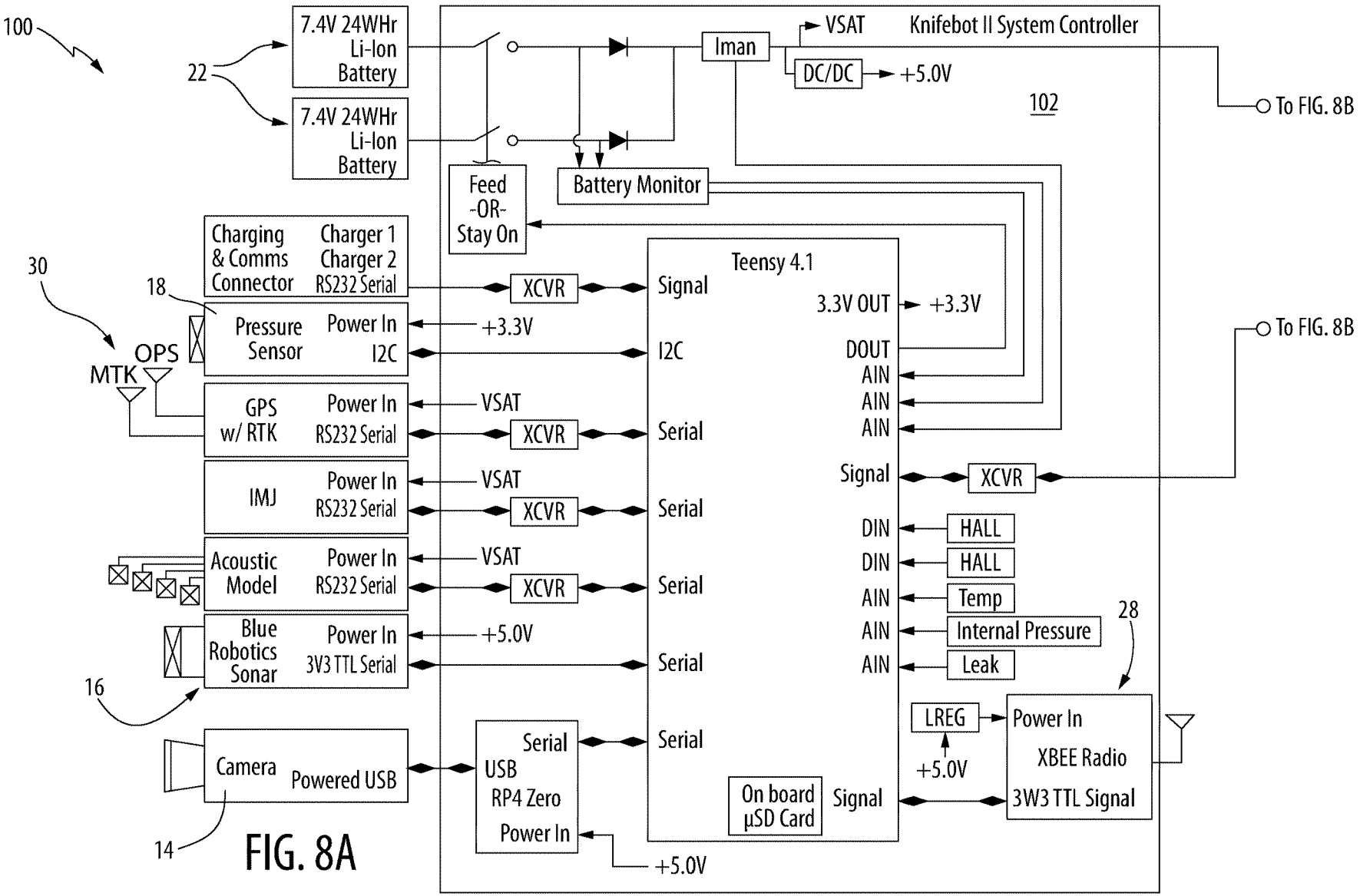
FIGS. 8A-8B together constitute a block diagram illustrating an exemplary control system of the underwater vehicle.
Figure 8B:
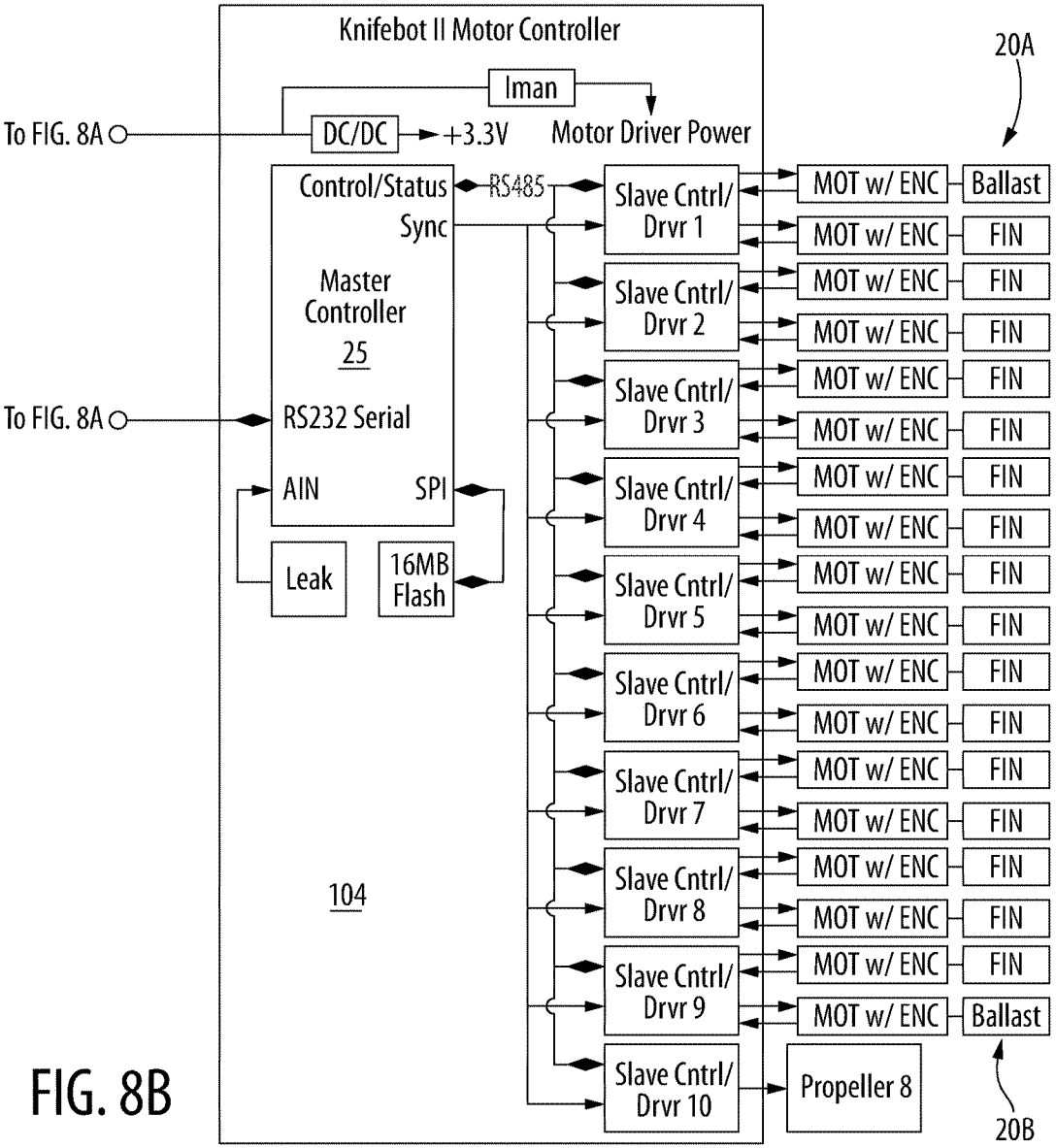

FIGS. 8A-8B together constitute a block diagram illustrating an exemplary control system 100 of the underwater vehicle 2. The control system 100 comprises a system controller 102 and a motor controller 104. The system controller 102 comprises the microcontroller 24 (e.g., ARM Cortex-M7 microprocessor at 600 MHz) which is coupled with all of the navigation/communications equipment, along with all of the sensors. Based on the information provided by the sensors, as well as the navigation and communications inputs, the microcontroller 24 controls the motor controller 104 which comprises its own microcontroller 25 (see exemplary command configurations in FIGS. 9A-9B). The motor controller 104 regulates a plurality of motor drivers (by way of example only, nine motor drivers), each of which drives a pair of motors 26A (e.g., DC motors) with associated encoders. The motor drivers themselves comprise microprocessors (not shown). The encoders provide feedback either to the driver microprocessors in a "low level" feedback scheme, or alternatively, the encoder feedback can be sent directly to the system controller 24. The motor controller 104 also controls the propeller 8 operation through its own driver, as also shown in FIG. 8B.

As also shown in FIG. 8A, other sensors included with vehicle 2 that are coupled directly to the system controller 102 are leak detectors (for detecting water leaks within the vehicle 2 and alerting the system controller 102), a temperature sensor, and an internal (hull) pressure sensor. A pair of Hall effect sensors are provided to act as emergency shutdown switches should the need arise to immediately shutdown the vehicle 2; this is accomplished by bringing an external magnet in the proximity of the vehicle 2 which activates the Hall effect sensors to shutdown the vehicle 2. An acoustic modem is also coupled to the system controller 102 to provide for acoustic communication, as well as for providing acoustic reference for positioning/localization; a plurality of hydrophones are also coupled to the system control 102 to detect underwater sounds and transmit data to the acoustic modem.

Figure 9B:
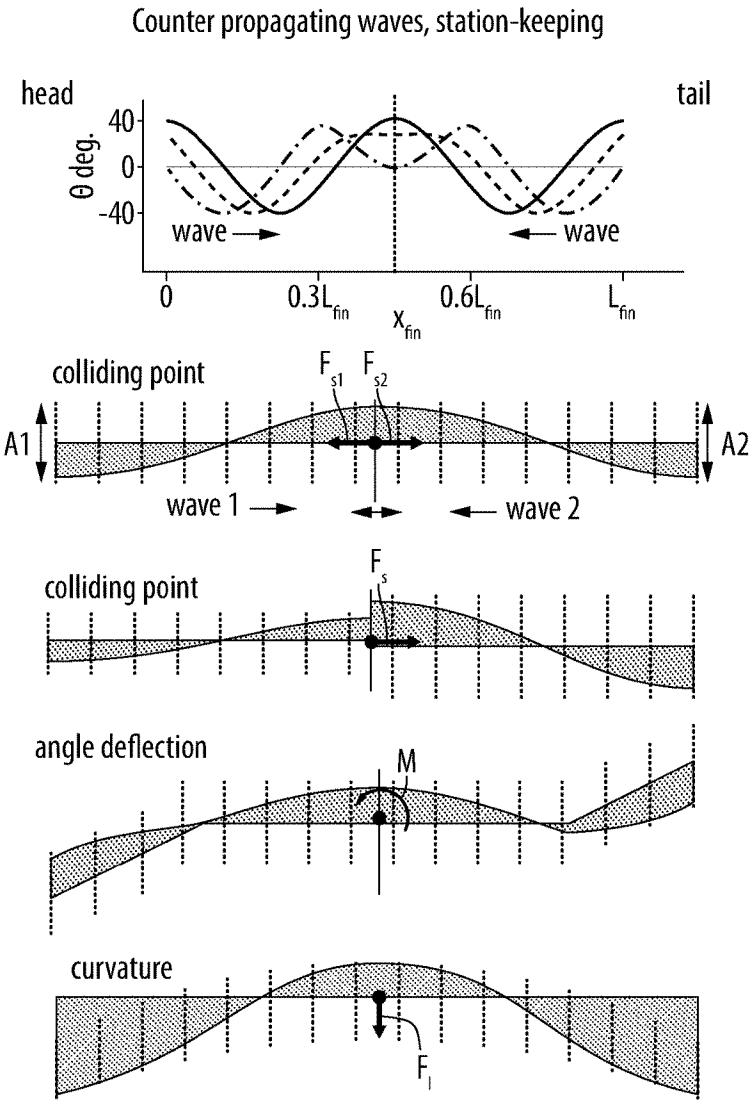
FIG. 9B depicts opposing traveling waves imposed on the robotic fin (again looking upward toward the ventral side) to permit the vehicle to remain in a fixed position (also referred to as "station-keeping") by having the opposed waves "collide" at a centerline ("x") of the vehicle, with the time plot showing the initial opposing waves (blue plot, at t1), the colliding waves (red wave, at t2) and the resultant wave (black wave, at t3) which holds the vehicle at the desired position.
Figure 9A:
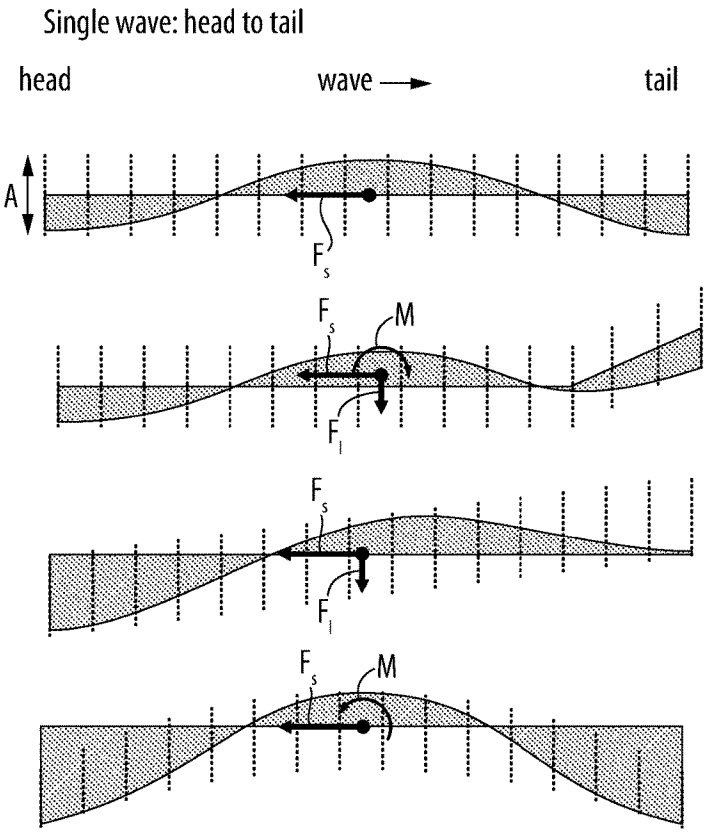
FIG. 9A are force diagrams of the robotic fin looking upward toward the ventral (bottom) side of the vehicle and showing four different robotic fin configurations used for maneuvering the vehicle.

FIG. 9A is a diagram illustrating the kinematics of an underwater vehicle including a single robotic fin. The diagram depicts the sinusoidal shape of the robotic fin 4 (FIG. 2A) when each actuator 26 (FIG. 2A) separately controls each ray 12 (FIG. 2A) of the fin 4 so that each ray 12 moves independently from the others in an undulating pattern. The diagram illustrates the directionality of the forces acting upon the fin 4, permitting the fit to flex and create a form with undulations 6 similar to an aquatic creature. The red vertical lines in FIGS. 9A-9B represent the location of each of the rays 12 and the length of each line represents and amplitude of the command to that ray 12. These undulations 6 permit the vehicle 2 to pitch (up/down motion), yaw (right/left movement) or roll (about a longitudinal axis of the hull 5) in small increments to achieve a precise maneuver. For example, altering amplitude or frequency of the traveling sinusoidal command wave can effect speed control whereas deflecting the fin 4 to one side or the other can effect a turn or pitch. In particular, four distinct fin configurations are shown, as viewed from a position underneath the vehicle 2, looking upward. The vertical red lines depict the amplitude A command provided to each ray 12, with the outline of the gray box, being representative of the robotic fin 4 contour, and with the green indicating the sinusoidal wave command. Several parameters are indicated in these figures, namely, a surge force $F_S$, a lateral force $F_1$, and torque or moment M.

FIG. 9B is a diagram illustrating the kinematics of an underwater vehicle for implementing a fixed position, also referred to as "station-keeping." To configure the robotic fin 4 to hold the vehicle 2 in a fixed position, two opposing traveling waves ("wave 1" and "wave 2") are commanded into the robotic fin 4, manifesting opposing surge forces, $F_{S1}$ and $F_{S2}$. The interaction of these two opposing waves is depicted in the upper plot at three distinct times, namely, t1, t2, and t3. As can be seen by the blue wave, the two opposing wave 1 (of amplitude A1) and wave 2 (of amplitude A2) move towards the centerline at time t1 and interact at time t2 at the "colliding point" (the centerline x of the vehicle), and the resultant black wave at t3 causes the robotic fin 4 to fix the vehicle 2 at a specific location. The remaining three plots labeled, "amplitude", "angle deflection," and "curvature" provide alternative robotic fin 4 fin configurations to effect the station-keeping mode.

While the invention has been described in detail and with reference to specific examples thereof, it will be apparent to one skilled in the art that various changes and modifications can be made therein without departing from the spirit and scope thereof.

What is claimed is:

1. An unmanned underwater vehicle for maneuvering in tight spaces, close to ocean structures or missions where a low-speed or station keeping function is necessary, said vehicle comprising:

a hydrodynamically-shaped hull having an external surface;

at least one robotic fin positioned on the external surface of the hull, the at least one robotic fin comprising a stretchable membrane that is flexible such that portions of the at least one robotic fin can undulate to cause said hull to pitch, yaw or roll in a confined underwater space, and a plurality of rays embedded within and supporting the stretchable membrane;

a sonar device for detecting underwater objects proximate said vehicle; and a controller, coupled to said sonar device, that commands said at least one robotic fin using at least one traveling sinusoidal wave to undulate said at least one robotic fin and maneuver in the confined underwater space.

2. The unmanned underwater vehicle of claim 1 further comprising a pressure sensor coupled to said controller for detecting the pressure external of said vehicle representative of a water depth of said vehicle.

3. The unmanned underwater vehicle of claim 2 wherein said controller is configured to command said at least one robotic fin using a second traveling sinusoidal wave that is oppositely-directed to said at least one traveling sinusoidal wave to effect station keeping of said vehicle.

4. The unmanned underwater vehicle of claim 1 further comprising a camera that is coupled to said controller.

5. The unmanned underwater vehicle of claim 1 further comprising a propeller located at a stern of said hull and coupled to said controller for activating said propeller to propel said vehicle underwater.

6. The unmanned underwater vehicle of claim 1 further comprising a radio coupled to said controller for effecting remote communication from and to said vehicle.

7. The unmanned underwater vehicle of claim 1 wherein each of the plurality of rays can be deflected to form the at least one traveling sinusoidal wave in the at least one robotic fin.

8. The unmanned underwater vehicle of claim 7 wherein each of the plurality of rays is individually controlled by a separate actuator, wherein each actuator is controlled by the controller.

9. The unmanned underwater vehicle of claim 1 further comprising a global positioning system coupled to said controller for effecting detection of the location of the unmanned underwater vehicle.

10. A method for maneuvering an unmanned underwater vehicle in tight spaces, close to ocean structures, or missions where a low-speed or station keeping function is necessary, said method comprising:

providing a hydrodynamically-shaped hull with at least one robotic fin positioned on an external surface of said hull, said at least one robotic fin comprising a stretchable membrane that is flexible such that portions of the at least one robotic fin can undulate to cause said hull to pitch, yaw, or roll in a confined underwater space, and a plurality of rays embedded within and supporting the stretchable membrane;

providing said hull with a sonar device for detecting underwater objects proximate to said vehicle;

coupling said sonar device to a controller within said hull for providing said controller with data regarding objects in the vicinity of said vehicle; and commanding said at least one robotic fin using at least one traveling sinusoidal wave, by said controller, to undulate said at least one robotic fin and maneuver said vehicle in the confined underwater space.

11. The method of claim 10 wherein said controller commands a plurality of actuators, each actuator coupled to one of the plurality of rays on the at least one robotic fin.

12. The method of claim 11 wherein said controller commands each actuator to move in unison with the rest of the plurality of actuators to move the at least one robotic fin as a single piece.

13. The method of claim 11 wherein said controller commands each actuator to move independently from the rest of the plurality of actuators to move the at least one robotic fin in an undulating pattern.

14. The method of claim 10 wherein the at least one robotic fin provides the only source of thrust during low-speed operation or station-keeping.

15. The method of claim 10 further comprising providing the hydrodynamically-shaped hull with a propeller coupled to the rear of the hull; and thrusting the unmanned underwater vehicle at high speeds by activating the propeller and maneuvering the unmanned underwater vehicle via commanding the at least one robotic fin.

16. The method of claim 10, further comprising:

commanding, via the controller, the at least one robotic fin using a second traveling sinusoidal wave that is oppositely-directed to said at least one traveling sinusoidal wave to effect station keeping of said vehicle.

17. The method of claim 10 further comprising providing said hull with a camera for detecting underwater objects proximate to said vehicle and coupling said camera to the controller within said hull for providing said controller with visual data regarding objects in the vicinity of said vehicle.

18. The method of claim 10 further comprising providing said hull with a global positioning system for detecting the position of the vehicle and coupling said global positioning system to the controller within said hull for providing said controller with data regarding the location of said vehicle.

19. The method of claim 10 further comprising provided said hull with acoustic sensors for recording sounds surrounding the vehicle and coupling said acoustic sensors to the controller within said hull for providing said controller with acoustic data.

20. The method of claim 10 further comprising transmitting and receiving wireless communications between the vehicle and another source selected from the group including another unmanned underwater vehicle, an aquatic structure, a land-based vehicle, air-based vehicle, and an external operator.

* * * * *